US005967948A

United States Patent [19]

Carr

[11] Patent Number: 5,967,948

[45] Date of Patent: Oct. 19, 1999

[54] ADJUSTABLE WEIGHTLIFTING APPARATUS

[76] Inventor: John Patrick Carr, 124 Hope La., Highland Heights, Ky. 41076

[21] Appl. No.: 09/026,989

[22] Filed: Feb. 20, 1998

[51] Int. Cl.[6] ..... A63B 21/075

[52] U.S. Cl. ..... 482/93; 482/106

[58] Field of Search ..... 482/93, 106–109, 482/139

[56] References Cited

U.S. PATENT DOCUMENTS

| | | | |
|---|---|---|---|
| 4,360,198 | 11/1982 | Waulters | 482/106 |
| 4,429,870 | 2/1984 | Gibbs | 482/93 |
| 4,943,052 | 7/1990 | Powers | 482/106 |

*Primary Examiner*—John Mulcahy
*Attorney, Agent, or Firm*—Frost & Jacobs LLP

[57] ABSTRACT

An improved adjustable weightlifting apparatus is provided. The weightlifting apparatus includes a central frame portion that further includes first and second elongated supports. Additionally, the weightlifting apparatus includes one or more elongated handles. In addition, each handle includes a gripping portion and a connecting end that attaches to a corresponding end of one of the elongated supports of the central frame. The weightlifting apparatus further includes an elongated weight support bar that is attached to the lower ends of the first and second supports of the central frame. Weights may be retained by a sliding collar or similar means on the elongated handles, the weight support bar, or both as desired by the user and depending on the exercise chosen. In one preferred embodiment, each connecting end of the handles is pivotally attached to a corresponding top end of one of the supports of the central frame by a pivotable union. In a second preferred embodiment, the weight support bar includes a pair of upwardly extending connectors that are adapted to be removably connected with either a connecting end portion of one of the handles or a corresponding support of the central frame in such a manner so that the weightlifting apparatus may be used either with or without the central frame portion.

13 Claims, 5 Drawing Sheets

ADJUSTABLE WEIGHTLIFTING APPARATUS

TECHNICAL FIELD

The present invention relates generally to weightlifting apparatus, and is particularly directed to a new and improved weightlifting apparatus that is adjustable to target different muscle groups and that carries weights in such a manner as to have a relatively lower center of gravity to promote exercise efficiency.

BACKGROUND OF THE INVENTION

In addition to more elaborate weightlifting equipment comprising or including a plurality of levers, pulleys, weight plates, and various types of mechanical linkages, the traditional weightlifting apparatus has been and still remains a single, straight elongated bar fitted with collars near the ends thereof to retain weighted plates on the bar. A typical free-weight exercising barbell may consist of a pair of substantially equal weights spaced apart near the opposite ends of the bar. The center of gravity of a typical barbell is generally located somewhere along the axis of the gripping bar, usually at the midpoint. The standard straight bar has been widely used for many years for a variety of weightlifting exercises, including, by way of example, military and bench presses, curls, upright and bent-over rows and tricep extensions.

During a typical set for a given exercise, an individual performs a series of repetitions by lifting the barbell between lower and upper positions so that targeted muscles will be stressed. The movement of the gripping hands, depending on the exercise, will generally be along a path having a large vertical component. Some exercises, upright rows for example, require substantially straight up and down motion of the barbell. Other exercises, such as curls, require the hands to move along a somewhat arcuate path having both horizontal and vertical components.

One common exercise done with a free-weight barbell is the curl during which an exerciser may stand with the upper body torso generally aligned vertically. Upon executing curls, the exerciser's gripping hands may move along an arcuate path around the elbow in order to stress the biceps. During one curl repetition, the upper arms will preferably be kept generally aligned with and at the sides of the upper body torso. In the lowered position, the arm is substantially straight, so that the lower arms between the elbows and the hands are also generally aligned with and at the sides of the weight lifter. To raise the barbell from the lowered position, the exerciser bends his arms only at the elbows, while the upper arms generally remain at the exerciser's sides. In the raised position, the lower arms are angled upwardly away from the elbows.

The upright row is an exercise used to develop the upper back, shoulders, and trapezius muscles. During a repetition of this exercise, a weightlifter grips the bar with the palms of the hands facing the user in a standard upright position. The spacing between the user's hands may be varied in order to stress the targeted muscles in different ways. From a lowered position, the user then pulls the barbell upward until the hands are approximately parallel with the shoulders. The barbell is then lowered to the starting position and repeated as desired to complete a set. An exerciser bending approximately 90° at the waist may do bent rows, a variation of the upright row. This variation of the upright row exercise is adapted to target the middle and upper back muscles.

Although standard barbells are useful for exercising targeted muscle groups, the standard barbell exhibits a number of shortcomings. For example, because barbells are unrestricted in movement, and because the weights generally lie along the axis of the barbell, a fatigued user may easily use body momentum, rocking, or bouncing of the weight in order to perform a particular exercise. Accordingly, when a user's muscles tire, or when the weight is too heavy to begin with, the weight lifter may break from proper form and start using jerky or bouncing movement. Such bouncing and jerking movements, when used to complete a repetition will not yield the proper exercise results as compared with proper form and may injure the weightlifter. Another disadvantage of standard barbells is that they do not allow a user to significantly vary angle of grip in order to stress muscles from many different angles.

SUMMARY OF THE INVENTION

Accordingly, it is a primary object of the present invention to provide an improved weightlifting apparatus that reduces a user's ability to utilize body momentum, such as rocking or bouncing of the weights, to assist in the exercise and to promote continuous tension on the targeted muscles substantially throughout their full ranges of motion.

Another object of the present invention is to provide an improved weightlifting apparatus that allows the user to select from among a number of angles of grip in order to stress muscles from varying angles.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved adjustable weightlifting apparatus is provided. The weightlifting apparatus includes a central frame portion that further includes first and second elongated supports. Additionally, the weightlifting apparatus includes one or more elongated handles. In addition, each handle includes a gripping portion and a connecting end portion that attaches to a corresponding end of one of the elongated supports of the central frame. The weightlifting apparatus further includes an elongated weight support bar that is attached to the lower ends of the first and second supports of the central frame. Weights may be retained by a sliding collar or similar means on either elongated handles or the weight support bar as desired by the user and depending on the exercise chosen.

In one preferred embodiment of the invention, each connecting end portion of the handles is pivotally attached to a corresponding top end of one of the supports of the central frame by a pivotable union.

In a second preferred embodiment, the weight support bar includes a pair of upwardly extending connectors that are adapted to be removably connected with either a connecting end portion of one of the handles or a corresponding support of the central frame in such a manner so that the weightlifting apparatus may be used either with or without the central frame portion.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without department from the invention. Accordingly, the drawings and descriptions will be regarded as illustrative in nature and not as restrictive.

BRIEF DESCRIPTION OF THE DRAWINGS

The accompanying drawing incorporated in and forming a part of the specification illustrate several aspects of the present invention, and together with the description and claims serve to explain the principles of the invention. In the drawings:

DETAILED DESCRIPTION OF THE PREFERRED EMBODIMENT

Figure 1:
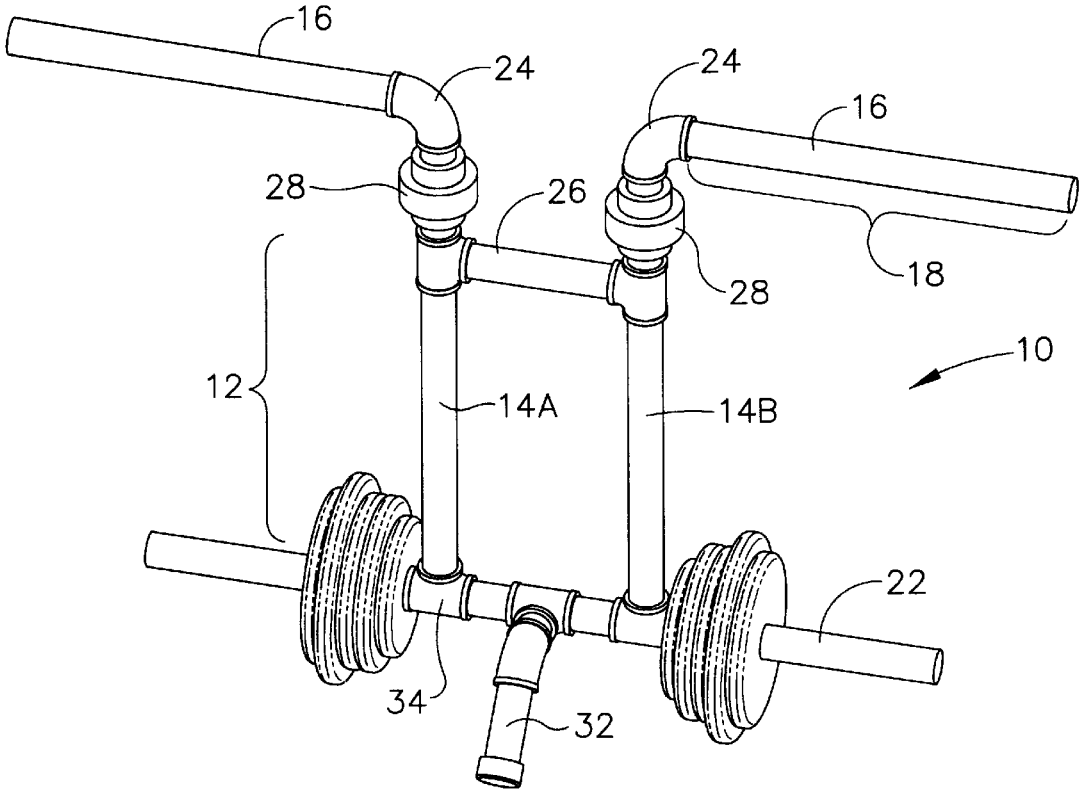
FIG. 1 is a perspective view of the weightlifting apparatus of the present invention with 90-degree angled handles installed thereon.

Reference will now be made in detail to the present preferred embodiment of the invention, an example of which is illustrated in the accompanying drawings, wherein like numerals indicate the same elements throughout the views. Referring now to the drawings, FIG. 1 shows the adjustable weightlifting apparatus of the present invention, generally designed by the numeral 10. Preferably, the weightlifting apparatus 10 includes a central frame portion 12, comprising a pair of first and second spaced-apart and preferably substantially vertical elongated supports 14*a*, 14*b*.

As shown in FIGS. 1–10, the weightlifting apparatus 10 of the present invention further includes one or more elongated handles 16. Preferably, the weightlifting apparatus 10 comprises two such handles 16. Each handle 16 comprises a gripping portion 18, which a user may grasp during use of the weightlifting apparatus. The gripping portion 18 may be knurled or textured to provide greater friction to prevent slippage during use. Additionally, gripping portion 18 may include contours or other ergonomic indentations or protrusions to enable a user to grip the handles 16 with increased comfort and stability. Foam grips or other similar devices may also be employed to add greater comfort and stability for the user. The handles 16 further comprise a connecting end portion 20 that is adapted to be releasably attached to a corresponding first end of one of the first and second spaced supports 14*a*, 14*b*.

The weightlifting apparatus 10 further includes an elongated weight support bar 22. Preferably, the weight support bar 22 is connected with the lower end of the each of the vertical supports 14*a*, 14*b* of the central frame portion 12. As shown in the figures, the weight support bar 22 may be connected with the vertical supports by a pair of t-shaped joints 34 disposed about the support bar 22. The t-shaped joints preferably include a threaded aperture that receives a corresponding threaded end of the vertical supports 14*a*, 14*b*. Obviously, other methods of attaching the vertical supports 14*a*, 14*b* to the weight support bar may be utilized such as welding, casting the components as one integral piece, linking the various members with threaded connectors or any other suitable manner as known in the art.

Preferably, the handles 16, the components of the central frame portion 12, and the weight support bar 22 are comprised of a steel bar, similar to the steel bars employed as weightlifting bars in the prior art. As is typical, it is preferable that the various framework components of the weightlifting apparatus 10 have a circular cross-section and an outer diameter of about 1 inch. Obviously, components of the weightlifting apparatus 10 may be comprised of substantially any material exhibiting the necessary strength and durability.

Preferably the handles are somewhat elongated so as to enable the user to position his hands at varying distances apart within a relatively wide range to accommodate the user as to the type of exercise desired. In addition, and to add a further measure of flexibility for a user, the gripping portion 18 and connection portion 20 of the handles are separated by an angled bend 24. In order to allow a user to exercise a wide variety and target a wide variety of muscles, angled bend 24 may comprise an angle in the range of between about 45° and about 135°. Angled bend may comprise a standard elbow joint connector, as shown in the figures, that link the connecting portion 20 and gripping portion 18 of the handles. Alternatively, each handle 16 may be formed of one integral length of steel bar (or other similar material) having an angled bend 24 formed between the connecting portion 20 and the gripping portion 18.

Figure 9:
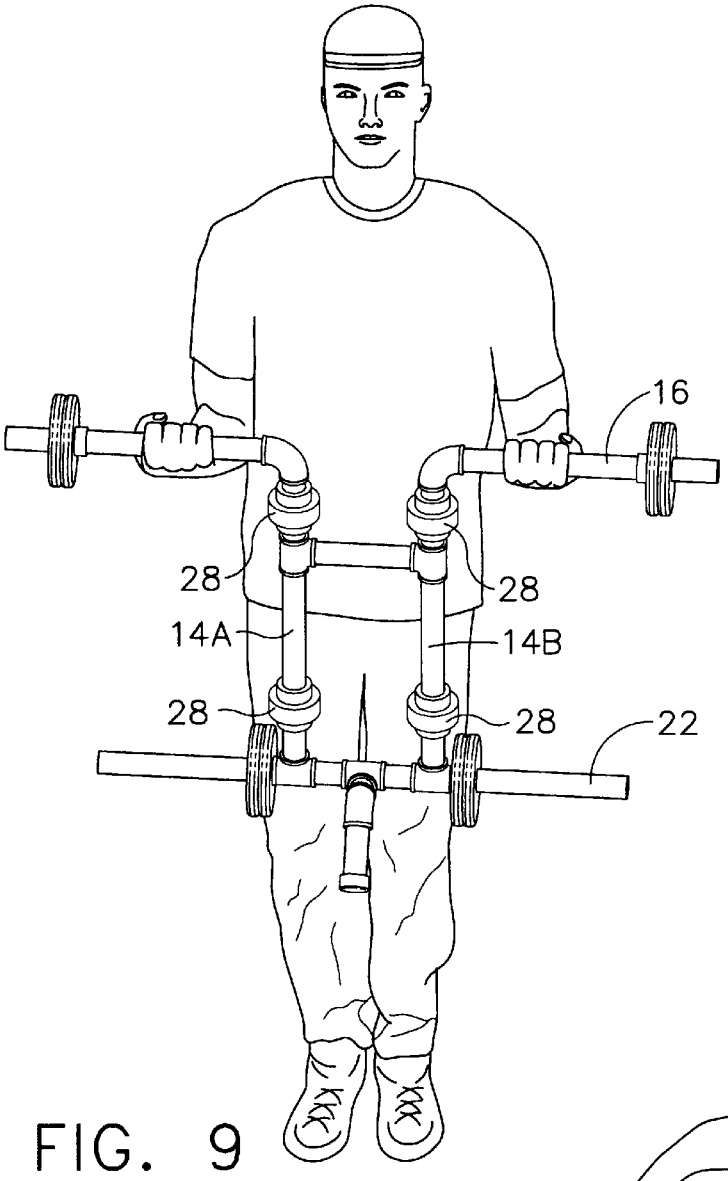
FIG. 9 is a perspective view showing a user doing a repetition of a curl with the weightlifting apparatus of the present invention.

More preferably, the weightlifting apparatus 10 may be provided with a variety of interchangeable handles 16 having angled bends of varying sizes. For example, as shown in FIGS. 1 and 9, angled bend 24 may comprise an angle of approximately 90°. As shown in FIG. 9, and in order to exercise the biceps, the user may use the 90° handles to perform curls. To perform a curl repetition, a user grips the gripping portion of the handles with the palms of the hands preferably facing upwardly. The user then pulls the apparatus upward in a curling motion until the hands are approximately parallel with the shoulders. In order to complete the repetition, the user then lowers the apparatus to the starting position shown in FIG. 9.

Figure 2:
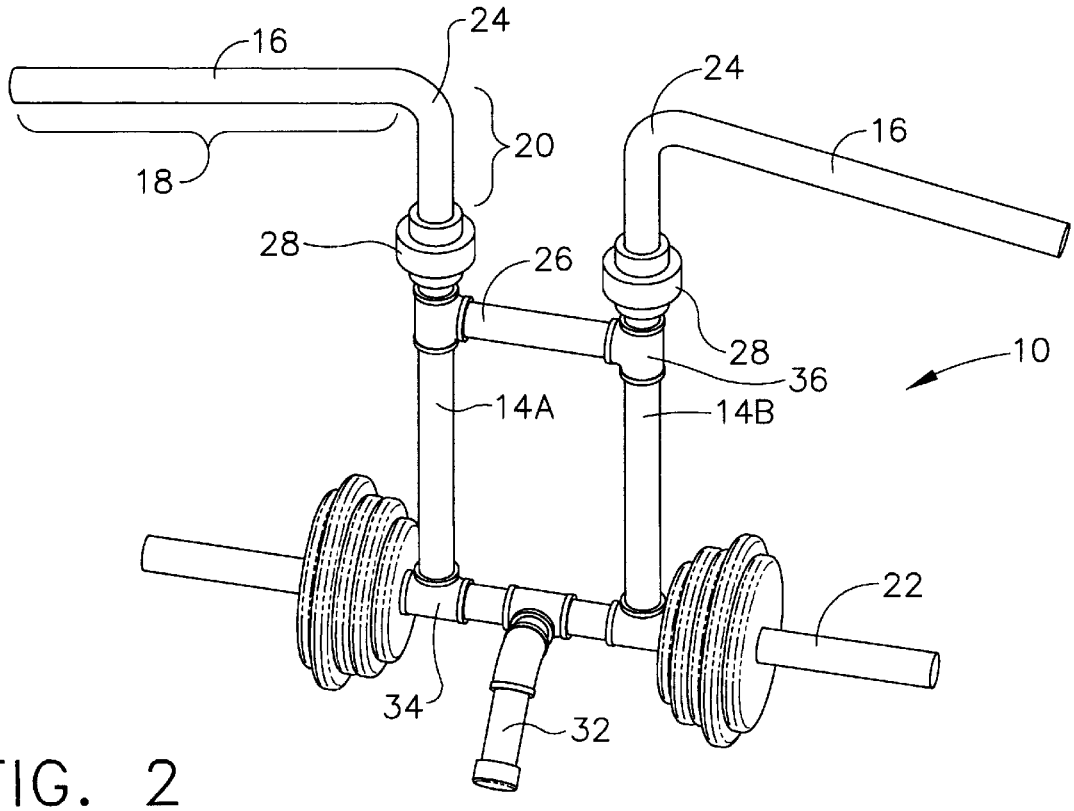
FIG. 2 is a perspective view of the weightlifting apparatus of the present invention with 65-degree angled handles installed thereon.
Figure 3:
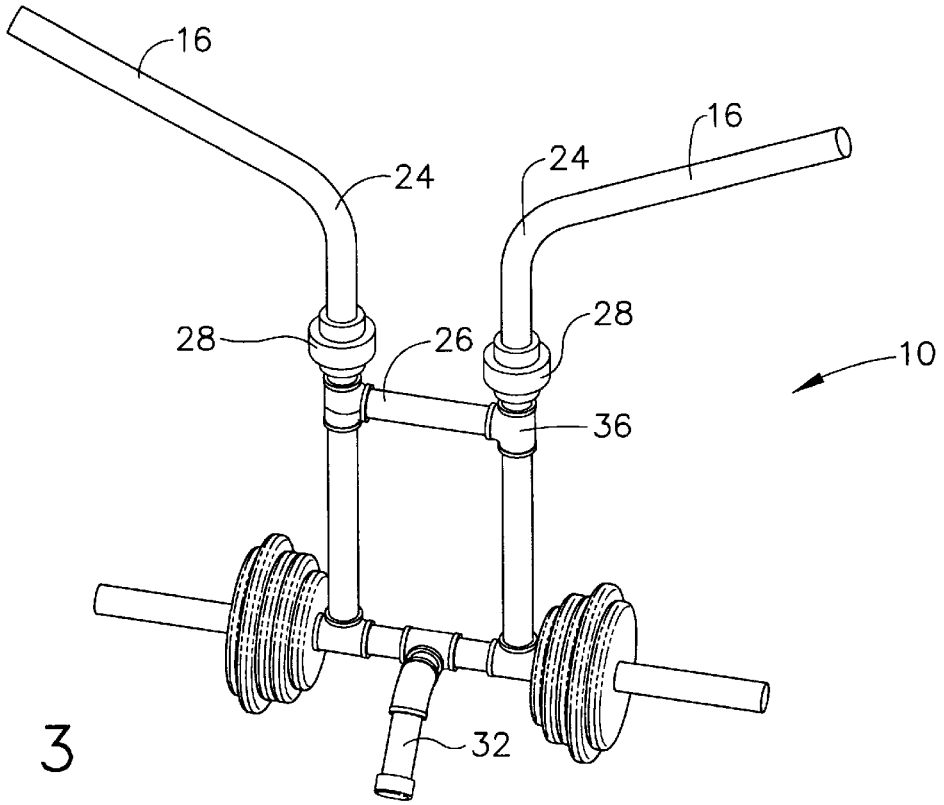
FIG. 3 is a perspective view of the weightlifting apparatus of the present invention with 100-degree angled handles installed thereon.

In order to stress the biceps from different angles, obtusely angled (FIG. 3) or acutely-angled (FIG. 2) handles may be used for performing curls. For example, as shown in FIG. 2, handle 16 having approximately 65° angled bends 24 may be used. As shown in FIG. 3, handles 16 having an angled bend 24 of an obtuse angle may also be used with the weightlifting apparatus 10 of the present invention. As shown in FIG. 3, preferably obtuse angled handles are approximately 135°. Changing the angle of the handles 16 changes the angle of the grip and shifts the center of gravity that advantageously alters the path or form of the lifting and lowering motions. This in turn prevents the muscles from physiologically adapting to one motion that would tend to reduce exercise efficiency. For curls, it is preferred not to use handles that are acutely angled so as to put undesirable stress on the elbows.

Figure 8:
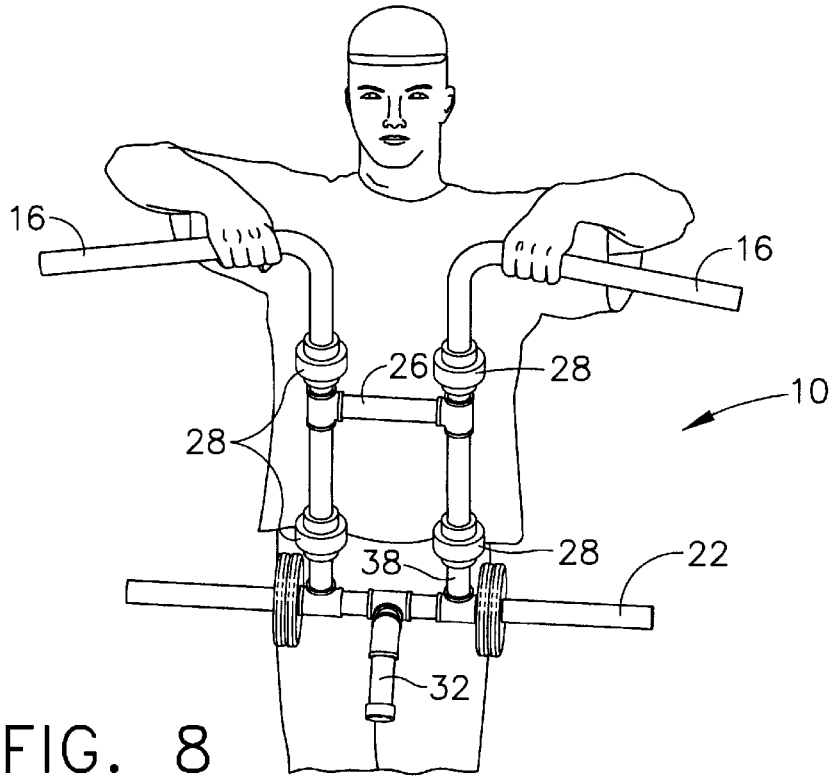
FIG. 8 is a perspective view showing a user doing a repetition of an upright row with the weightlifting apparatus of the present invention.

In order to target the trapezium, shoulder, and upper and middle back muscles, the user may also perform upright rows with the exercise apparatus 10 of the present invention. As shown in FIG. 8, to perform a repetition of this exercise, the user grips the apparatus with the palms of the hands facing downwardly. The apparatus is then pulled upwardly until the hands are approximately parallel with the shoulders, as shown in FIG. 8. In order to complete the repetition, the user then lowers the apparatus to the starting position. For the upright rows, a user may use a set of 90° handles 16 to afford the user a comfortable grip and allow for a full range of motion similar to that allowed a user of a standard barbell. Alternatively, acutely angled or obtusely angled handles may be used to alter the lifting and lowering form as desired to advantageously stress the targeted muscles from a different angle.

As shown in FIGS. 1–10, the weightlifting apparatus 10 may further be provided with a crossbar 26 disposed substantially perpendicularly with to the first and second vertical supports of the central frame portion. Crossbar 26 is disposed between and connected with the two vertical support members 14*a*, 14*b* of the central frame portion 12 in order to provide additional stability and support for the weightlifting apparatus 10. As shown in the figures, the crossbar 26 may be connected with the vertical supports 14*a*, 14*b* by a pair of cross bar retaining t-shaped joints 36. Preferably, each crossbar retaining joint 36 is disposed about a corresponding vertical support member 14*a*, 14*b*. As with the t-shaped joints 34 that retain the weight support bar 22, the crossbar retaining t-shaped joints 36 preferably each include a threaded aperture that receives a corresponding threaded end of the crossbar 26. Obviously, other methods of attaching the vertical supports 14*a*, 14*b* to the weight support bar may be utilized such as welding, linking the various members with threaded connectors, casting the components as one integral piece, or any other suitable manner as known in the art.

Figure 5:
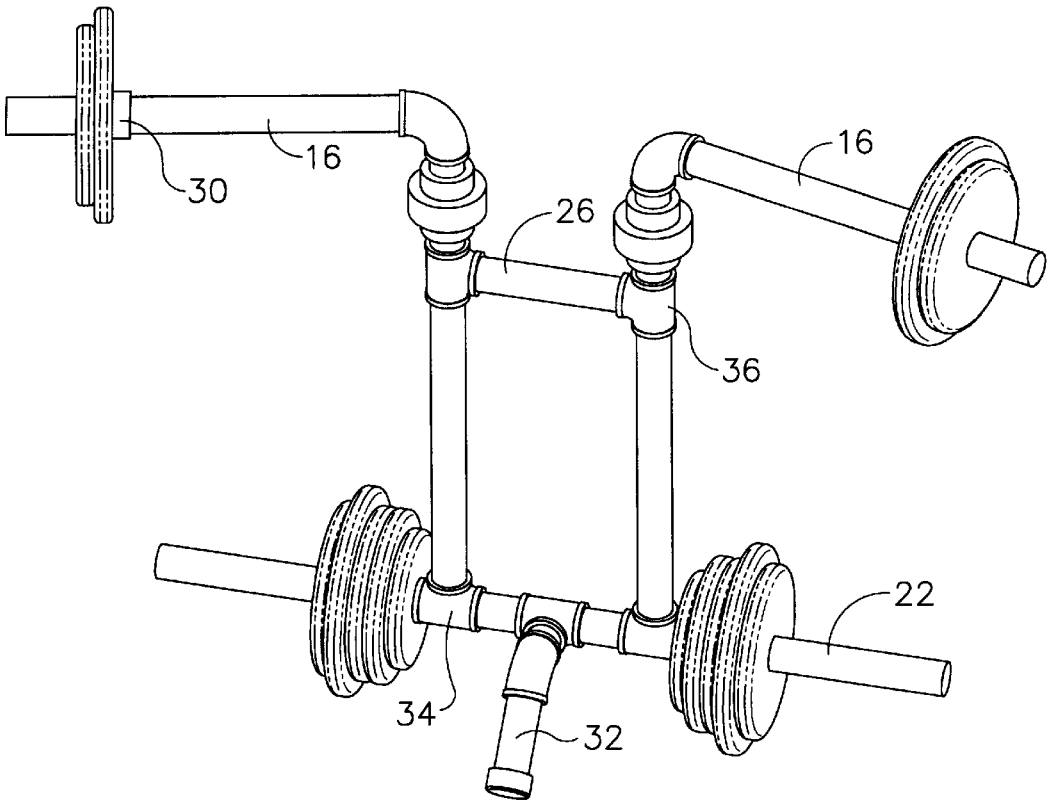
FIG. 5 is a perspective view of the weightlifting apparatus of the present invention with handles pivoted at an angle within the handle unions.

According to an important aspect of the present invention, the connecting end portion of each of the handles 20 may be pivotally attached to a corresponding end of one of the vertical supports 14*a*, 14*b* of the central frame portion 12 by means of a pivotable union 28 adapted to be selectively rotatable and securable in selected positions so that the handles may be pivoted and secured in any one of a number of predetermined positions as desired by a user and as dictated by the needs of the exercise being performed. Advantageously, the pivotable union 28 is capable of quickly releasing handles 16 so that a user may interchange handles of varying configurations as desired while exercising with a minimum amount of "down time" due to reconfiguring the equipment. Additionally, and as shown in FIG. 5, the handles 16 may be rotated outwardly or inwardly from the user as desired and fixed in place by tightening the pivotable union 28 in place once the handles are pivoted to the desired angle by the user. For example, the handles may be rotated 10° to 15° away from the user in order to create a more natural grip than with the standard straight bar. Further, by rotating the handles outwardly, a user is prevented from using body momentum, such as rocking or bouncing the weight, which enables the user to perform various exercises more correctly.

Figure 4:
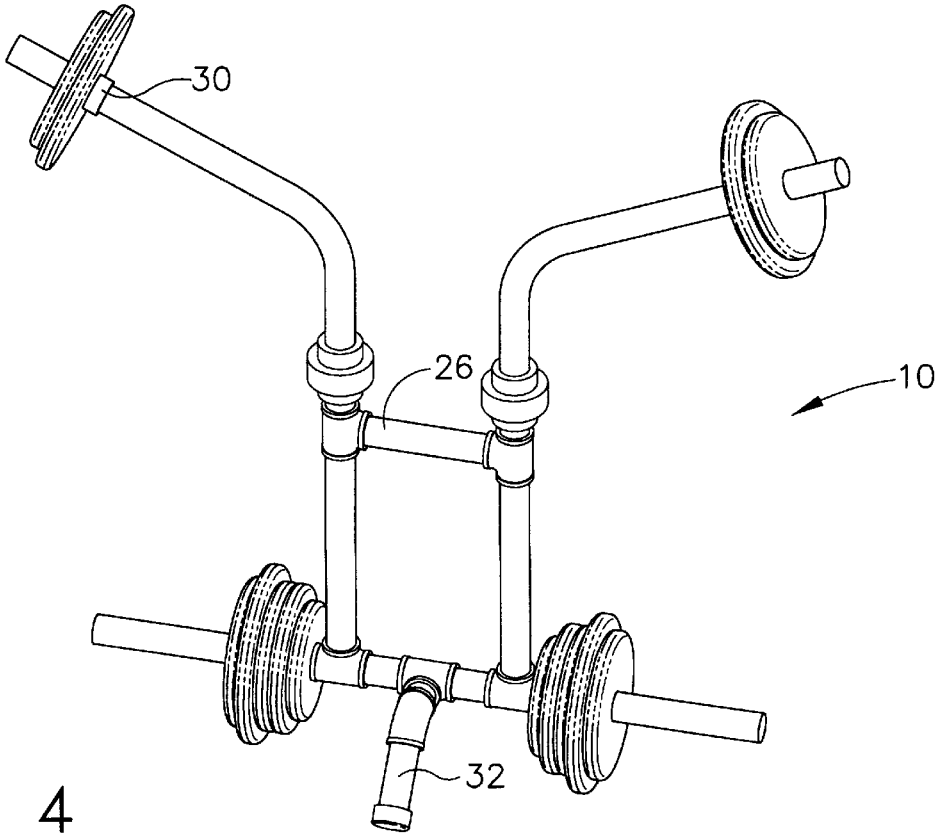
FIG. 4 is a perspective view of the weightlifting apparatus of the present invention having weights on the angled handles as well as the lower bar.

As should be appreciated, and as shown in FIGS. 4, 5, and 9, weightlifting apparatus 10 is capable of bearing weights on either the elongated handles 16, the weight support bar 22, or both. As described previously, these components are preferably substantially round in cross-section and have an outer diameter of approximately one inch so as to accommodate the standard weights in much the same manner as a typical weight bar. For example, as shown in FIG. 9, more weight on the handles 16 may be used than on the weight support bar 22 for a user performing curls. This configuration allows the user to perform a curl in much the same manner as with a regular barbell. The minimal amount of weight on the weight support bar (which will vary depending on each individual's strength and training needs) advantageously prevents or restricts the user from using momentum-rocking or bouncing the weight to help in performing the exercise. This configuration also helps to keep continuous tension on the biceps throughout the full range of motion of the curl repetitions.

Additionally, as shown in FIG. 5, more weight may be used on the weight support bar 22 than on the handles 16. For example, this configuration may aid a user performing certain exercises, such as upright rows. More weight on the weight support bar 22 allows the user a full range of motion with the arms. However, with the majority of the weight lowered below the level of grip, the user is advantageously prevented from using momentum-rocking or bouncing of the weight to help perform the exercise.

In addition, as shown in FIGS. 4 and 5, weights may be releasably retained on the various components of the weightlifting apparatus 10 by means of any suitable retaining device know in the art, such as the slidable locking collar 30 shown, which may serve to prevent the weights from being displaced from the desired positions.

Figure 6:
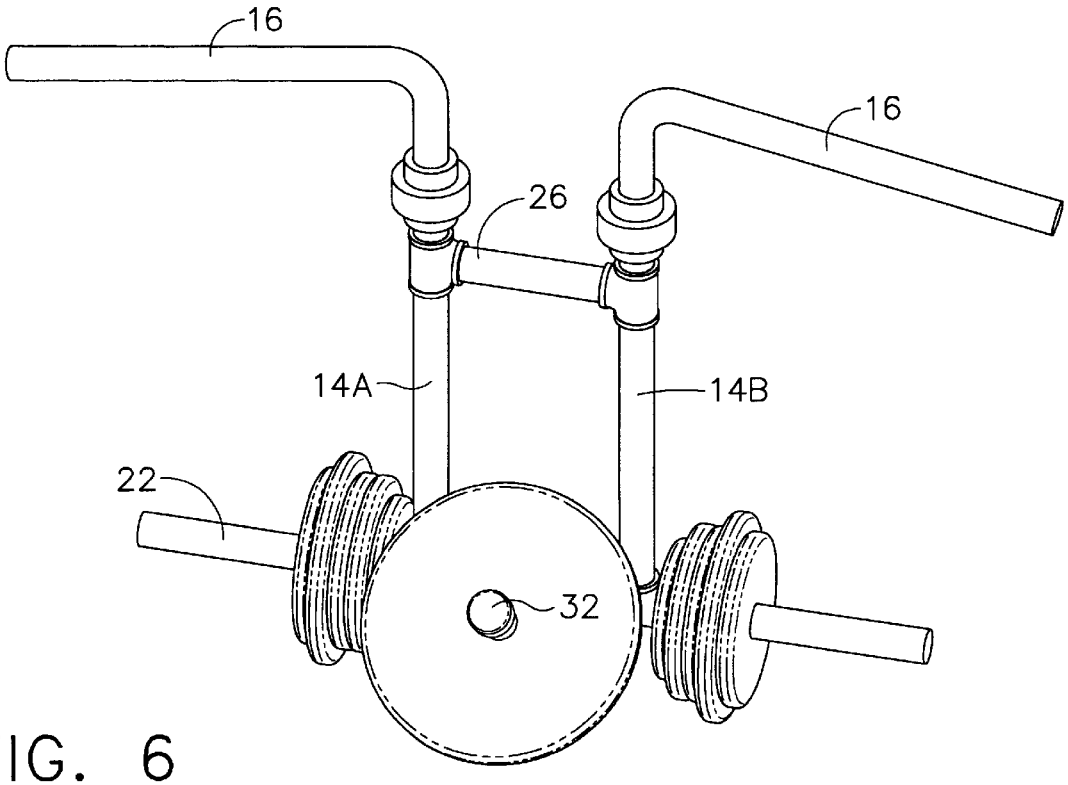
FIG. 6 is a perspective view of the weightlifting apparatus of the present invention showing additional weight being carried by the pivotable stand.

As shown in the Figures, weightlifting apparatus 10 may be provided with a pivotable stand 32. Preferably, stand 32 is threaded into the weight support bar 22 substantially at its midpoint. Preferably, this stand 32 includes a threaded end which is received into a corresponding threaded aperture in weight support bar 22. Alternatively, a lock nut, or similar device, may be used so that the stand may be pivoted upwardly and locked in position as shown in FIG. 6, in order to accept additional weight plates or to allow the user to remove the stand as desired.

Figure 7:
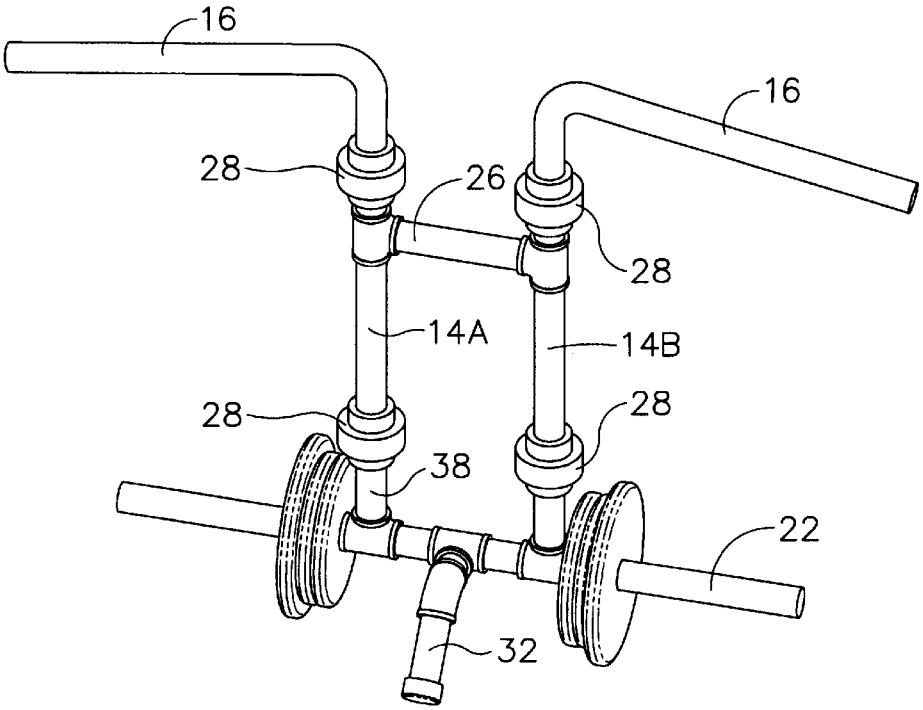
FIG. 7 is a perspective view of an alternate embodiment of the weightlifting apparatus of the present invention having four unions.

As best shown in FIGS. 7–9, the weightlifting apparatus 10 may be provided with an additional pair of pivotable unions 28. This second pair of pivotable unions, together with the first upper pair of unions, advantageously allows for the central frame 12 to be removable if desired. In addition to rendering apparatus 10 capable of breaking down with ease and compactness for storage, additional exercises may be performed with the apparatus 10 with the central frame so removed.

Figure 10:
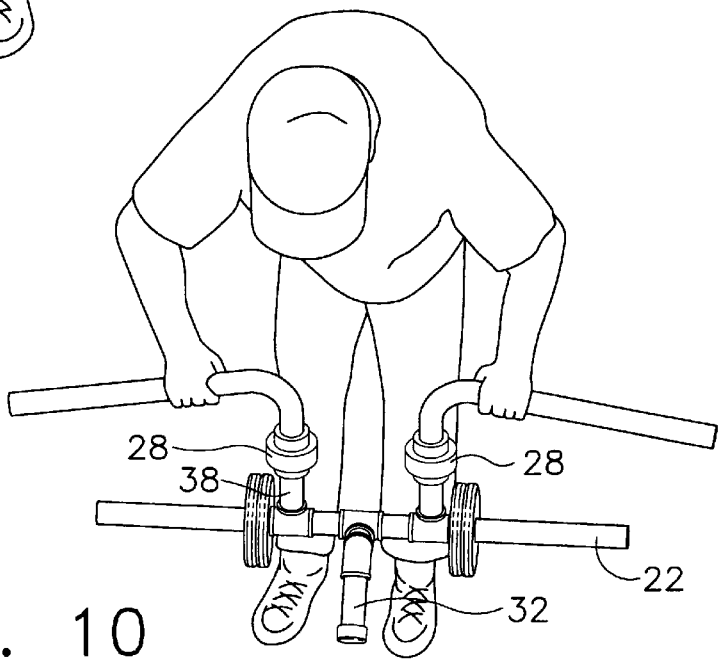
FIG. 10 is a perspective view showing a user doing a repetition of a bent-over row with the weightlifting apparatus of the present invention having the central frame removed.

For example, this removability of the central frame portion allows the user to use the weightlifting apparatus 10 of the present invention for a variety of exercises in addition to those described previously such as the bent over row, as depicted in FIG. 10. Bent over rows target the muscles of the middle and upper back. When the apparatus 10 is used for this exercise with the central frame 12 removed, more clearance between the user and the floor is achieved. To perform a repetition of this exercise, the user bends over approximately 90° at the waist. The apparatus 10 is gripped with the palms of the hands facing downwardly. The apparatus is then pulled upwardly to the middle of the user's torso then returned to the starting position.

Additionally, muscles may be stressed differently by performing the same exercise both with and without the central frame 12 in place. For example, when curls are performed using the apparatus 10 without the central frame 12 in place and with weights on both the handles 16 and the weight support bar 22, the biceps may be stressed in a different manner. Specifically, as a user performs a curl repetition with the apparatus configured as just described, additional beneficial stress on the biceps is achieved as the lower weights on the weight support bar 22 pivot upwardly and outwardly from the user as the apparatus is curled.

In order to accommodate the removable frame, the weight support bar 22 may include a pair of upwardly extending connectors 38. Each connector 38 is adapted to be removably connected by a pivotable union with either a corresponding end portion of one of the handles 16, or a corresponding lower end of one of the spaced vertical supports 14*a*, 14*b* of the central frame portion 12. As should be appreciated, when the central frame 12 is removed, handles 16 may be selectively rotatable and securable in selected positions in the same manner as with the other pivotable unions described above. Accordingly, the handles may be pivoted and secured in any one of a number of predetermined positions as desired by a user and as dictated by the needs of the exercise being performed whether the apparatus 10 is used with or without the central support frame 12. Similarly, as described previously, the handles 16 may be rotated outwardly or inwardly from the user as desired and fixed in place by tightening the pivotable unions 28 in place once the handles are pivoted to the desired angle by the user. For example, the handles may be rotated 10° to 15° away from the user in order to create a more natural grip than with the standard straight bar. Further, by rotating the handles outwardly, a user is prevented from using body momentum, such as rocking or bouncing the weight, which enables the user to perform various exercises more correctly.

The foregoing description of a preferred embodiment of the invention has been presented for the purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended thereto.

What is claimed is:

1. A weightlifting apparatus comprising:

a. a central frame, said frame comprising first and second elongated supports, said first and second supports each having first and second ends;

b. one or more elongated handles, each of said one or more elongated handles comprising a gripping portion, each of said one or more elongated handles further comprising a connecting end portion, each said connecting end portion of said one or more elongated handles being attached to a corresponding first end of one of said first and second elongated supports, each of said one or more elongated handles further adapted to be capable of releasably retaining weights by weight retaining means; and c. an elongated weight support bar, said elongated weight support bar being attached to said second ends of said first and second supports;

d. an elongated stand attached to said weight support bar, said stand being adapted to be capable of being pivoted into a substantially upwardly oriented position whereby said stand may selectively carry additional weights as desired by a user;

whereby one or more weights may be releasably retained by weight retaining means on at least one of said stand, said weight support bar and said one or more elongated handles as desired by a user.

2. The weightlifting apparatus of claim 1, wherein said one or more elongated handles comprises two handles.

3. The weightlifting apparatus of claim 2, wherein said gripping portion and said connecting end portion are separated by an angled bend.

4. The weightlifting apparatus of claim 3, wherein said angled bend comprises an angle in the range of between 45° and 135°.

5. The weightlifting apparatus of claim 4, wherein said first and second elongated supports are parallel to each other and spaced apart.

6. The weightlifting apparatus of claim 5, wherein said central frame further comprises a crossbar, said crossbar having first and second ends, said first end of said crossbar further being attached to said first support and wherein said second end of said crossbar being attached to said second support.

7. The weightlifting apparatus of claim 6, wherein said support bar is perpendicular to said first and second supports.

8. The weightlifting support bar of claim 7, wherein said weight support bar extends equidistantly from each of said first and second supports.

9. The weightlifting apparatus of claim 2, wherein each said connecting end portion of said handles is pivotally attached to a corresponding first end of said first and second supports by a pivotable union, said pivotable union adapted to be selectively rotatable and securable in selected positions whereby said handles may be selectively secured in any one of a plurality of predetermined positions as desired by a user.

10. The weightlifting apparatus of claim 9, wherein said weight support bar further includes first and second upwardly extending connectors, said connectors being adapted to be removably connected with either a corresponding connecting end portion of one of said handles or a corresponding second end of one of said first and second supports by a pivotable union, said pivotable union adapted to be selectively rotatable and securable in selected positions whereby said weightlifting apparatus may be used with or without said central frame portion.

11. The weightlifting apparatus of claim 10, wherein said angled bend comprises an angle of 90°.

12. The weightlifting apparatus of claim 10, wherein said angled bend comprises an angle of 65°.

13. The weightlifting apparatus of claim 10, wherein said angled bend comprises an angle of 100°.

* * * * *

UNITED STATES PATENT AND TRADEMARK OFFICE

CERTIFICATE OF CORRECTION

PATENT NO. : 5,967,948

DATED : October 19, 1999

INVENTOR(S) : John Patrick Carr

It is certified that error appears in the above-identified patent and that said Letters Patent is hereby corrected as shown below:

In Col. 3, Line 50, "designed" should read as --designated--

Signed and Sealed this

First Day of August, 2000

*Attest:*

Q. TODD DICKINSON

*Attesting Officer*

*Director of Patents and Trademarks*